US008147034B2

(12) United States Patent
Tagawa et al.

(10) Patent No.: US 8,147,034 B2
(45) Date of Patent: Apr. 3, 2012

(54) LIQUID DISCHARGE RECORDING HEAD AND RECORDING APPARATUS

(75) Inventors: Yoshinori Tagawa, Yokohama (JP); Junichi Kobayashi, Ayase (JP); Kenji Fujii, Kawasaki (JP); Hiroyuki Murayama, Kawasaki (JP); Makoto Watanabe, Yokohama (JP); Taichi Yonemoto, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 324 days.

(21) Appl. No.: 12/476,541

(22) Filed: Jun. 2, 2009

(65) Prior Publication Data

US 2009/0303289 A1 Dec. 10, 2009

(30) Foreign Application Priority Data

Jun. 5, 2008 (JP) ..... 2008-148127

(51) Int. Cl.
*B41J 2/135* (2006.01)

(52) U.S. Cl. ..... 347/45

(58) Field of Classification Search ..... 347/40, 347/45, 47

See application file for complete search history.

(56) References Cited

U.S. PATENT DOCUMENTS

| | | | | |
|---|---|---|---|---|
| 6,286,933 | B1 | 9/2001 | Murakami et al. | |
| 6,318,842 | B1 * | 11/2001 | Shimomura et al. | 347/45 |
| 7,168,787 | B2 * | 1/2007 | Jung et al. | 347/47 |
| 7,410,241 | B2 | 8/2008 | Yabe | |

FOREIGN PATENT DOCUMENTS

| | | | |
|---|---|---|---|
| JP | H11-005307 | A | 1/1999 |
| JP | 2006-103320 | A | 4/2006 |

* cited by examiner

*Primary Examiner* — An Do

(74) *Attorney, Agent, or Firm* — Canon USA Inc. IP Division

(57) ABSTRACT

A liquid discharge recording head includes a flow passage forming member having discharge ports and a flow passage, the discharge ports configured to discharge droplets, the flow passage communicating with the discharge ports. The flow passage forming member also has a first opening and a second opening, the first opening provided at a surface of the flow passage forming member with the discharge ports, the second opening causing the inside of the first opening to communicate with the outside of the flow passage forming member through a communication passage.

10 Claims, 9 Drawing Sheets

FIG. 3A1
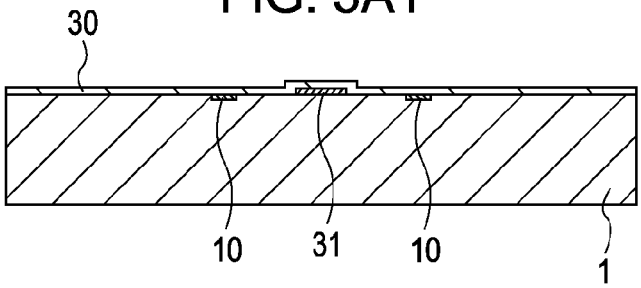
FIG. 3B1
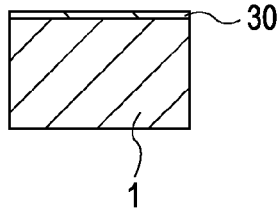
FIG. 3A2
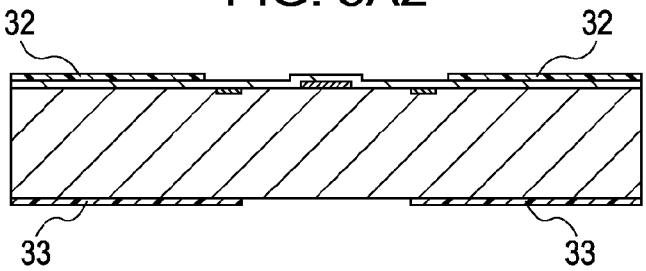
FIG. 3B2
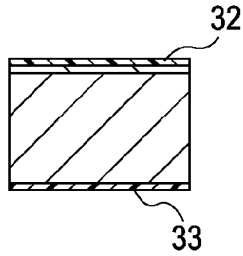
FIG. 3A3
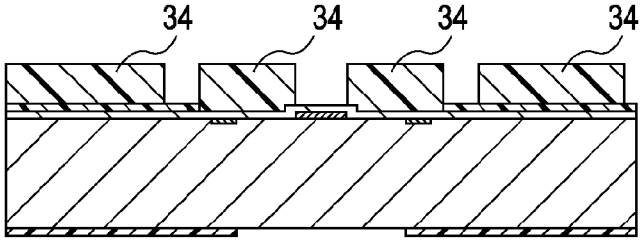
FIG. 3B3
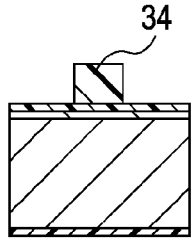
FIG. 3A4
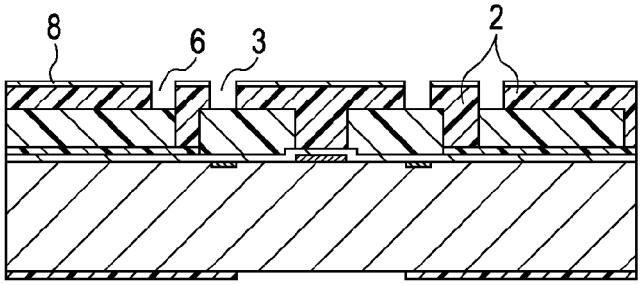
FIG. 3B4
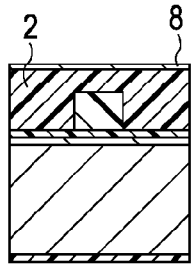

FIG. 4A1
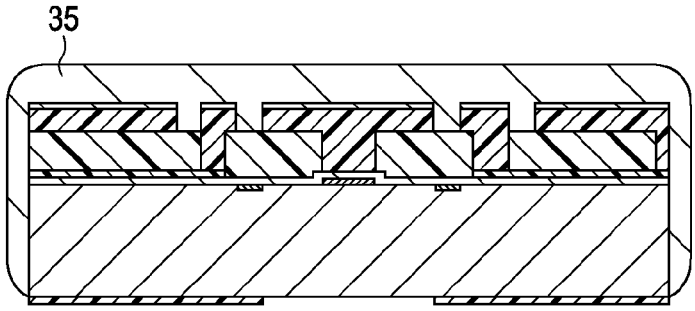
FIG. 4B1
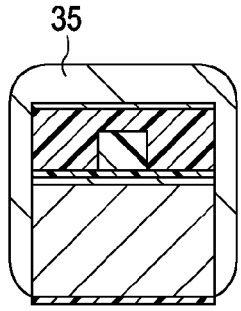
FIG. 4A2
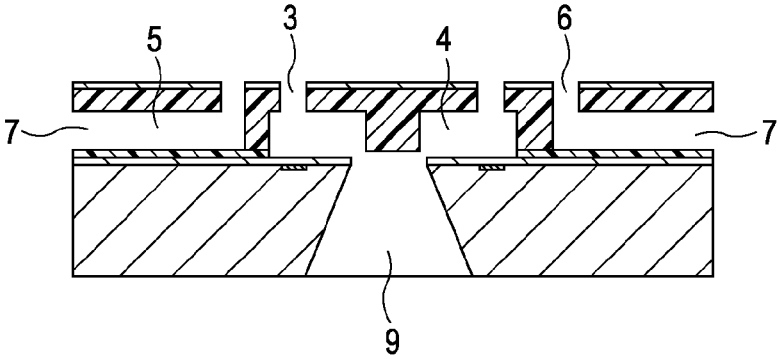
FIG. 4B2
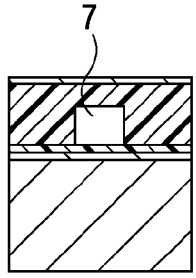

LIQUID DISCHARGE RECORDING HEAD AND RECORDING APPARATUS

BACKGROUND OF THE INVENTION

1. Field of the Invention

The present invention relates to a liquid discharge recording head and a recording apparatus, and more particularly to a liquid discharge recording head capable of stably discharging droplets.

2. Description of the Related Art

When a recording operation is performed using a liquid discharge recording head (hereinafter, occasionally referred to as recording head), very small droplets (mist) may be discharged in addition to mainly used droplets (hereinafter, referred to as main droplets). Hereinafter, such very small droplets are referred to as small droplets.

The small droplets adhere to a surface with droplets-discharging ports (face) by airflow generated when a liquid is discharged from the recording head and when the recording head performs reciprocation scanning. When the small droplets adhere to the face and are accumulated on the face, discharging of the main droplets may become unstable, possibly deteriorating image quality of a recorded image. Owing to this, cleaning of the face with a blade that wipes out the face, and a recovery operation by sucking the droplets from the recording head have to be frequently performed during the recording operation. The recovery operation may reduce the speed of the recording operation.

Japanese Patent Laid-Open No. 11-5307 discloses a recording head to prevent unstable discharging. The recording head disclosed in Japanese Patent Laid-Open No. 11-5307 includes a flow passage forming member having a plurality of discharging ports. An evaporation suppressing groove is formed near the discharging ports.

The evaporation suppressing groove is hydrophilic, and hence, can hold small droplets adhering to the face. Accordingly, the humidity around the discharging ports is increased, and hence evaporation of the droplets from the discharging ports is prevented, thereby improving stability of discharging.

Meanwhile, in order to increase the speed of the recording operation, it is effective to increase a drive frequency of discharging the droplets. However, when the drive frequency is increased, the small droplets adhering to the face of the flow passage forming member may be easily moved by, for example, an inertial force applied when the recording head performs reciprocation scanning.

By the movement of the small droplets, the small droplets are combined and become large droplets with larger diameters. When the face may be excessively wet, the droplets may enter the discharge ports, resulting in unstable discharging or non-discharging of the droplets. In particular, this phenomenon may be noticeable when the recording head is a long recording head having more nozzles.

To address such a problem, Japanese Patent Laid-Open No. 2006-103320 discloses a recording head having another hydrophilic groove formed in the face.

The recording head disclosed in Japanese Patent Laid-Open No. 2006-103320 includes a flow passage forming member having a plurality of arrayed nozzles. Discharging ports of the nozzles are open to the face. The face has formed therein a circular hydrophilic groove surrounding all discharging ports. In addition, another hydrophilic groove is formed on both sides of the above hydrophilic groove in a main-scanning direction (a direction in which the recording head reciprocates during the recording operation), so as to extend in a sub-scanning direction (a direction perpendicular to the main-scanning direction).

Accordingly, the small droplets adhering to the face are dispersed to the plurality of hydrophilic grooves. Thus, the small droplets are prevented from locally staying in the hydrophilic grooves, and from leaking from the grooves.

However, with the recording head disclosed in Japanese Patent Laid-Open No. 11-5307 or 2006-103320, when the recording head is driven with a high frequency or when the droplets are continuously discharged, the small droplets may locally adhere to the face, and the amount of droplets may exceed the capacity of the hydrophilic grooves.

The small droplets exceeding the capacity may leak from the hydrophilic grooves by the inertial force applied when the recording head performs reciprocation scanning. Thus, to keep the image quality high during high-speed printing, the droplets in the grooves have to be drained after a predetermined recording operation.

The drain of the droplets is performed by sucking the droplets from the inside of the hydrophilic grooves while the face of the recording head is covered with a recovery unit.

The recovery unit includes a cap, a droplet-absorbing member provided in the cap, and a suction unit. A peripheral edge of the cap contacts an upper surface of a chip plate surrounding the flow passage forming member, so that the face is airtight. An air suction pipe is connected to the cap. The air suction pipe sucks the air in the airtight space.

In this state, by sucking the droplets by the sucking unit, the droplets staying in the hydrophilic grooves are drained.

In the recording head disclosed in Japanese Patent Laid-Open No. 11-5307 or 2006-103320, the pressure of the entire face covered with the cap is reduced when suction is performed during a recovery process.

With this configuration, it is difficult to collect all small droplets in the hydrophilic grooves, and the small droplets still remain in the hydrophilic grooves.

If the small droplets remain in the grooves, holding effect of the grooves for newly generated small droplets may be deteriorated. Hence, a liquid may leak from the grooves, the face may be wet, and discharging may become unstable.

To avoid this, the recovery process has to be frequently performed. This, however, decreases the speed of the recording operation.

SUMMARY OF THE INVENTION

In light of the above situations, the present invention provides a liquid discharge recording head with improved droplet-discharging stability without frequent repetition of a recovery operation.

The present invention also provides a recording apparatus including the liquid discharge recording head.

A liquid discharge recording head includes a flow passage forming member having discharge ports and a flow passage, the discharge ports configured to discharge droplets, the flow passage communicating with the discharge ports. The flow passage forming member also has a first opening and a second opening, the first opening provided at a surface of the flow passage forming member with the discharge ports, the second opening causing the inside of the first opening to communicate with the outside of the flow passage forming member through a communication passage.

With the configuration, droplet-discharging stability can be improved without an excessive reduction of a recording speed.

Further features of the present invention will become apparent from the following description of exemplary embodiments with reference to the attached drawings.

BRIEF DESCRIPTION OF THE DRAWINGS

FIGS. 3A1 to 3A4 and 3B1 to 3B4 are schematic illustrations showing manufacturing steps of the recording head of the first embodiment.

FIGS. 4A1 and 4A2, and 4B1 and 4B2 are schematic illustrations showing manufacturing steps of the recording head of the first embodiment.

DESCRIPTION OF THE EMBODIMENTS

Embodiments of the present invention are described below with reference to the attached drawings.

Figure 1A:
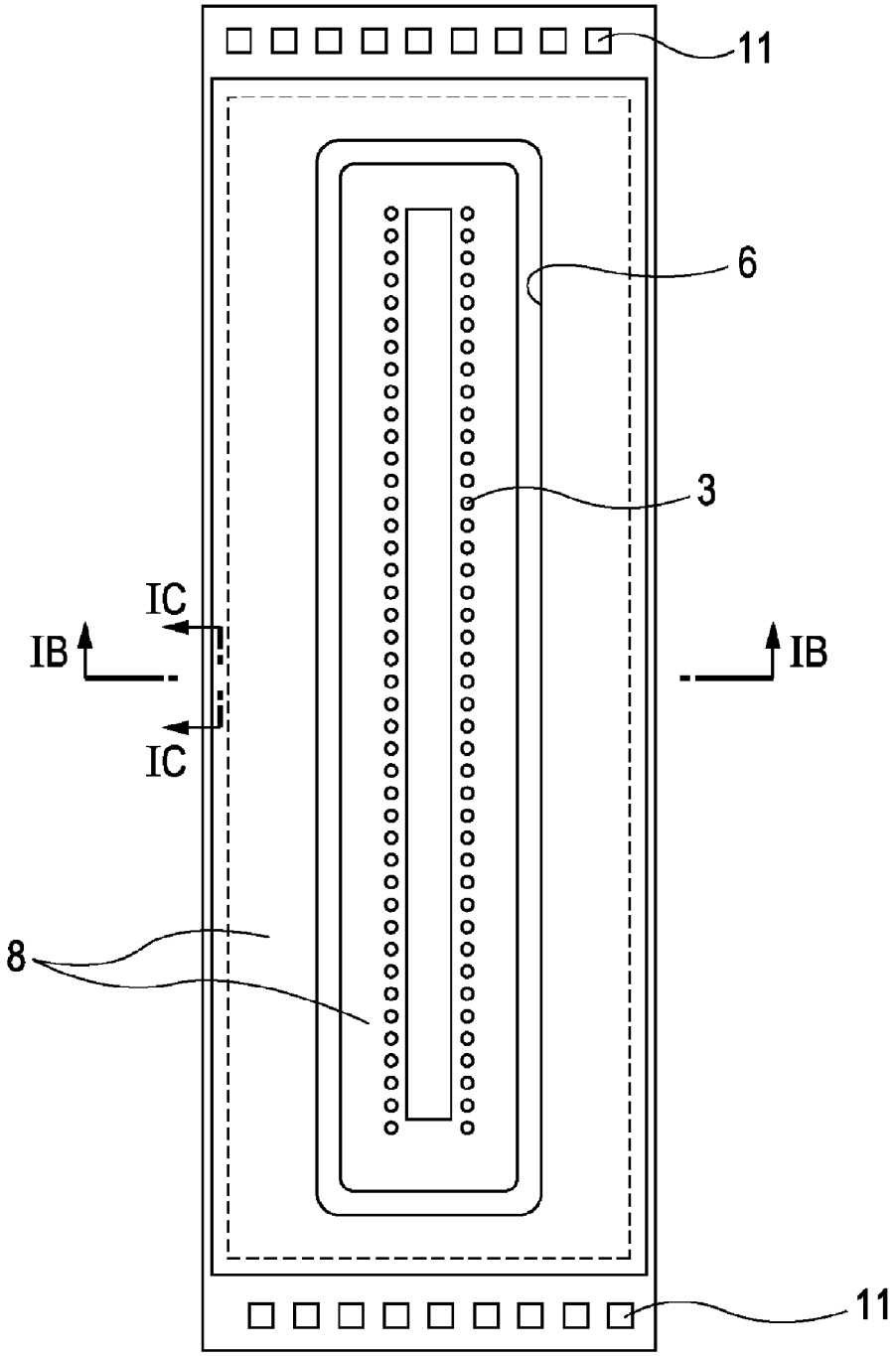
FIGS. 1A to 1C illustrate a recording head according to a first embodiment of the present invention, FIG. 1A being a schematic plan view, FIG. 1B being a schematic cross-sectional view taken along line IB-IB in FIG. 1A, FIG. 1C being a schematic cross-sectional view taken along line IC-IC in FIG. 1A.
Figure 1C:
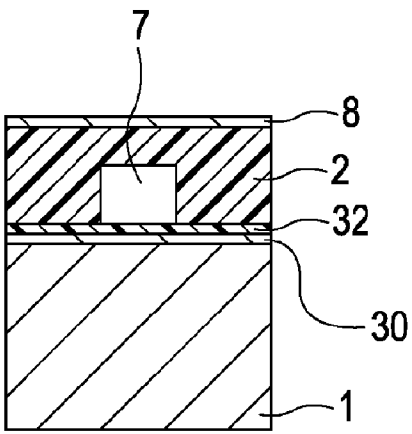
Figure 1B:
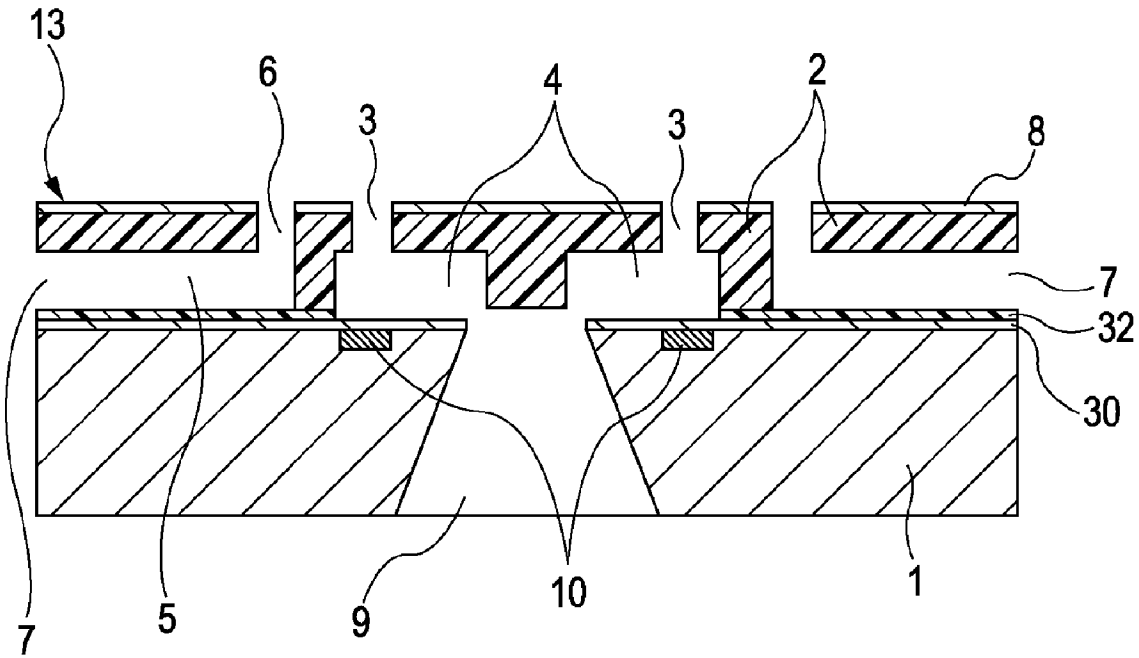

FIG. 1A is a plan view showing a face side of a liquid discharge recording head according to a first embodiment of the present invention. FIG. 1B is a cross-sectional view taken along line IB-IB in FIG. 1A. FIG. 1C is a cross-sectional view taken along line IC-IC in FIG. 1A.

The recording head includes a substrate 1 and a flow passage forming member 2.

The substrate 1 has two arrays of discharge energy generating elements 10 arranged at equal pitches. Also, the substrate 1 has a droplet supply port 9 between the two arrays of discharge energy generating elements 10. The substrate 1 may use a silicon (Si) substrate.

The flow passage forming member 2 is stacked on the substrate 1. The flow passage forming member 2 has nozzles 4 including discharge ports 3 that discharge a liquid and a flow passage communicating with the discharge ports 3. The flow passage forming member 2 may use covering photosensitive resin.

The discharge energy generating elements 10, which are formed respectively for the discharge ports 3 and generate energy used for discharging the liquid, may be heating resistors (heaters). The heaters are electrically connected to electrodes 11 provided at the substrate 1. The heaters generate heat by a predetermined electric signal, and increase the pressure of the inside of the nozzles 4. With the pressure, droplets in the nozzles 4 are discharged from the discharge ports 3. Accordingly, recording can be performed on a recording medium.

A protection film 30 and a first contact layer 32 are formed between the substrate 1 and the flow passage forming member 2. The protection film 30 and the first contact layer 32 are used in a manufacturing step of the recording head (described later).

The discharge ports 3 provided at the nozzles 4 are open to a face 13 (a surface with the discharge ports). The nozzles 4 are connected to the droplet supply port 9 formed at the substrate 1. Also, a water repellent member 8 is formed on the face-13-side surface of the flow passage forming member 2.

In this embodiment, the flow passage forming member 2 also has a first opening 6, and a second opening 7 that causes the inside of the first opening 6 to communicate with the outside of the flow passage forming member 2. A communication passage 5 is not connected to the droplet supply port 9.

The first opening 6 is formed at the face 13 to surround all discharge ports 3 in a circular form. The inside of the communication passage 5 extending from the first opening 6 to the second opening 7 has a higher hydrophilic property than that of the face 13. The hydrophilic property is desirably higher than that of the water repellent member 8.

In this embodiment, the second opening 7 is provided at side surfaces of the flow passage forming member 2.

Small droplets adhering to the face 13 pass through the first opening 6 and are held in the communication passage 5. Accordingly, non-discharging due to wetting of the face 13 can be prevented. In addition, the face 13 can be prevented from being excessively wet by the small droplets.

The communication passage 5 may have any shape as long as the communication passage 5 can hold the small droplets. For example, the communication passage 5 may be inclined in a direction away from the first opening 6 toward the face 13. The recording head is normally arranged in the recording apparatus while the face 13 faces the lower side. Accordingly, the droplets can stay in the communication passage 5, and the droplets can be prevented from leaking from the first opening 6.

The second opening 7 causes the communication passage 5 to communicate with the outside (outside air). Accordingly, the pressure of the inside of the communication passage 5 is not excessively reduced when the small droplets held in the communication passage 5 are to be drained by suction during the above-described recovery process. The liquid in the communication passage 5 can be efficiently drained from the discharge ports 3.

In this embodiment, since the second opening 7 is provided at the side surfaces of the flow passage forming member 2, the droplets can be prevented from flowing out of the second opening 7. Also, even if the ink leaks from the second opening 7, the ink does not adhere to the face 13. This is advantageous.

Figure 8:
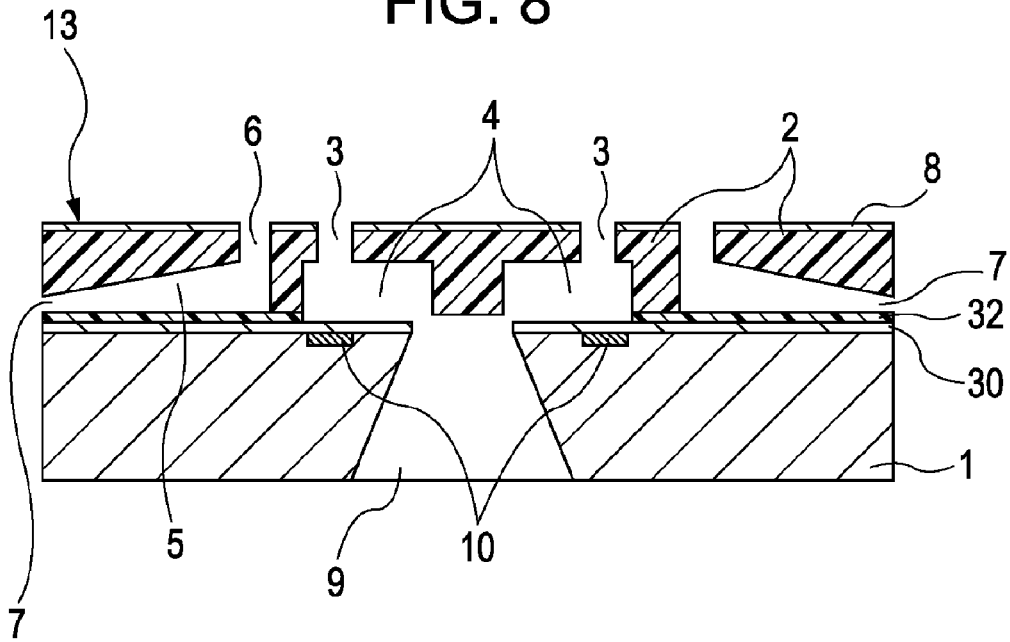
FIG. 8 is a schematic cross-sectional view showing the recording head according to the first embodiment of the present invention.

As shown in FIG. 8, the second opening 7 may be inclined upward (that is, a side provided with the substrate 1) from the communication passage 5 toward the side surfaces of the flow passage forming member 2. Accordingly, the droplets can be prevented from flowing out of the second opening 7. In addition to this structure, by decreasing the size of the opening so that the liquid forms a meniscus at the opening, the liquid can be prevented from leaking to the outside. The meniscus is easily broken by the suction operation through the discharge ports, and hence, the meniscus does not adversely affect the recovery operation.

In addition, in order to prevent the droplets from flowing out of the first and second openings 6 and 7, a liquid reservoir portion may be formed in the communication passage 5 by a partition wall or the like.

With the recording head of this embodiment, the communication passage 5 provided in the flow passage forming member 2 may be large. This increases the holding capacity of the droplets. In contrast, the area of the first opening 6 may be minimized. Accordingly, a blade to be used for cleaning of the face 13 is not pushed into the first opening 6 by a pressure.

Figure 7:
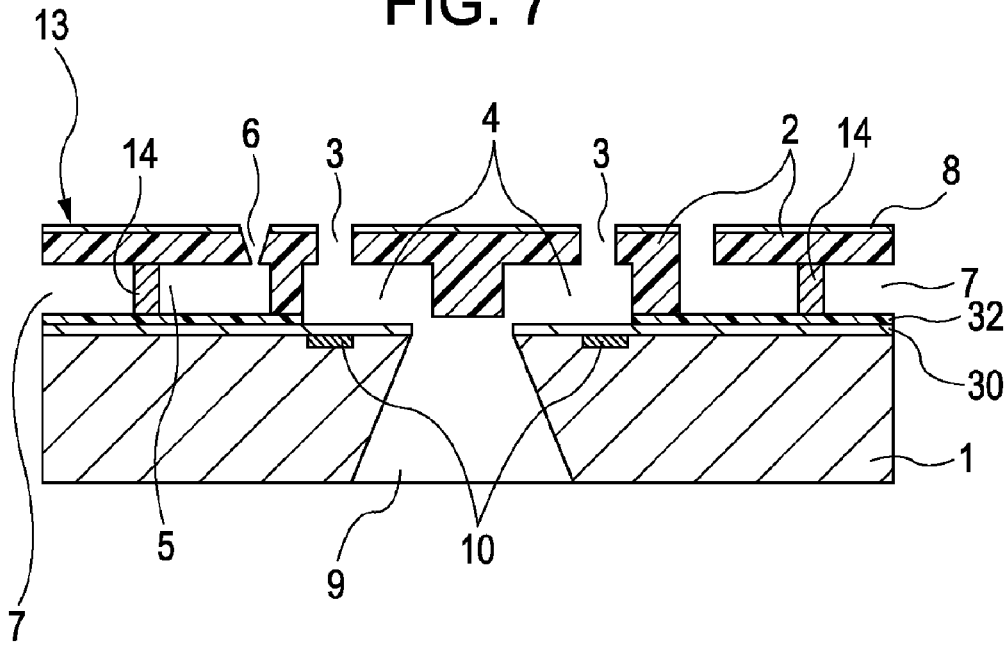
FIG. 7 is a schematic cross-sectional view showing the recording head according to the first embodiment of the present invention.

If the area of the communication passage 5 is large, durability of the flow passage forming member 2 may be decreased. In such a case, a column material 14 may be provided in the communication passage 5 as shown in FIG. 7. The column material 14 supports the flow passage forming member 2. A plurality of such column materials may be provided depending on the size and shape of a communication passage.

Also, as shown in FIG. 7, the first opening 6 may be tapered such that the opening diameter of the first opening 6 is decreased from the face 13 toward the communication passage 5. This is because the small droplets efficiently flow from the first opening 6 to the communication passage 5 by a capillary force.

Next, the recovery process to drain the small droplets held in the communication passage 5 is described. A recording apparatus provided with the liquid discharge recording head includes the recovery unit.

Figure 2:
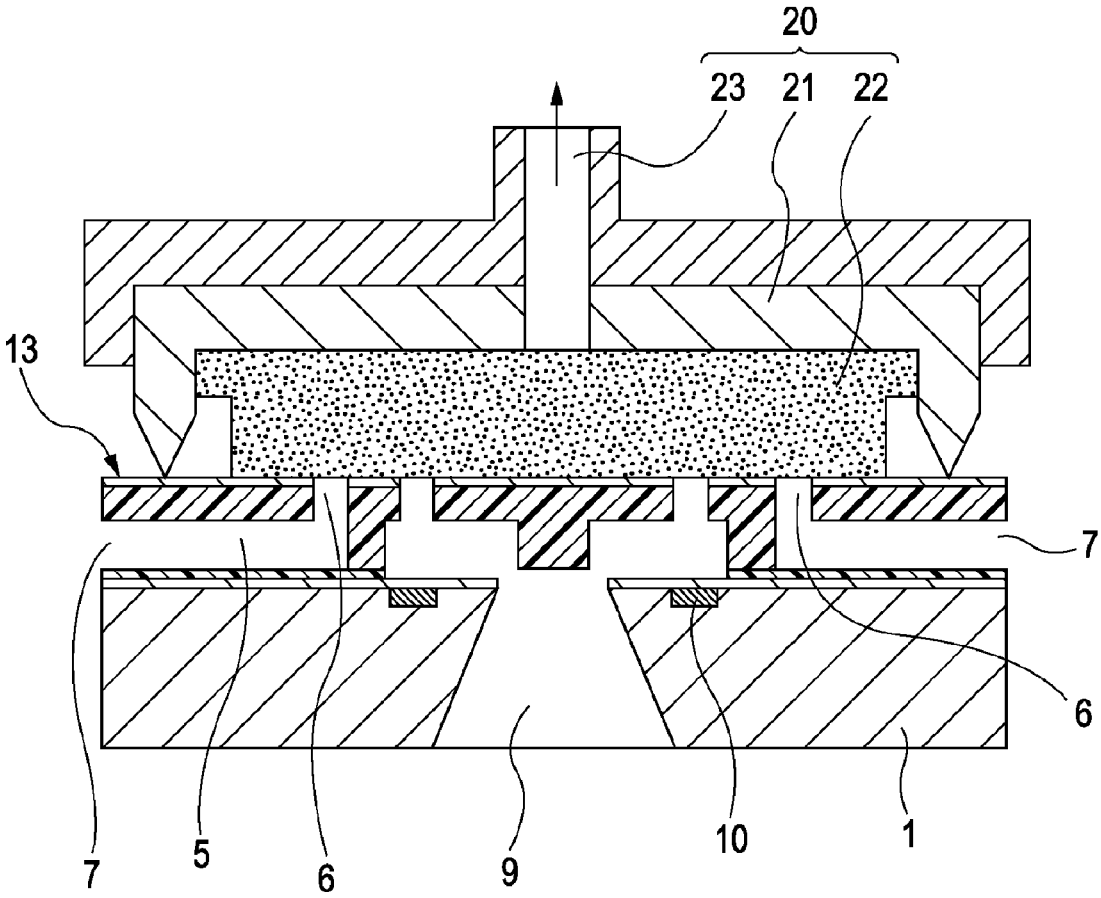
FIG. 2 is a schematic illustration showing a state in which a face of the recording head of the first embodiment is covered with a recovery unit.

During the recovery process, the recovery unit covers the face 13 of the recording head. FIG. 2 is a schematic illustration showing the state in which the recording head is covered with the recovery unit.

A recovery unit 20 includes a cap 21, a droplet absorbing member 22 provided in the cap 21, and a suction unit (not shown) such as a pump. Reference numeral 23 denotes a communication hole communicating with the pump.

The cap 21 is a substantially flat plate, and has a protruding portion at a peripheral edge of the cap 21. The protruding portion contacts a peripheral portion of the face 13 of the recording head.

The first opening 6 and the discharge ports 3 are arranged at positions covered with the cap 21 (inside the cap 21). The second opening 7 is arranged at a position outside the cap 21. Therefore, the first opening 6 and the discharge ports 3 are covered with the cap 21, and the second opening 7 is exposed to the outside of the cap 21.

In this state, the suction unit is driven, so as to suck the droplets in the area inside the cap 21 and the face 13. At this time, since the second opening 7 functions as a vent hole to the outside, the small droplets held in the communication passage 5 can be efficiently drained without the pressure in the cap 21 being an excessive negative pressure. The drained small droplets are absorbed by the droplet absorbing member 22.

Accordingly, the amount of droplets remaining in the communication passage 5 is markedly reduced after the recovery process. Accordingly, non-discharging because the face 13 is wet is prevented, and stable discharging can be continuously provided.

Simultaneously, in the recovery process, the droplets in the nozzles 4 are forcibly drained from the discharge ports 3. Accordingly, air bubbles staying in the nozzles 4, thickening droplets (droplets after a volatile component is evaporated), dusts, etc., can be drained with the droplets.

The recording apparatus includes a main-scanning mechanism, a sub-scanning mechanism, and an integrated control circuit. The main-scanning mechanism moves the liquid discharge recording head in the main-scanning direction. The sub-scanning direction moves a recording medium in the sub-scanning direction intersecting with the main-scanning direction.

The integrated control circuit is formed of a microcomputer, a driver circuit, etc. The integrated control circuit controls the operations of the liquid discharge recording head, the main-scanning mechanism, and the sub-scanning mechanism, in an integrated manner.

Next, manufacturing steps of the recording head of the first embodiment are described with reference to FIGS. 3A1 to 3B4, and 4A1 to 4B2.

FIGS. 3A1 to 3A4, and FIGS. 4A1 and 4A2, are schematic cross-sectional views taken along a line corresponding to line IB-IB in FIG. 1A. FIGS. 3B1 to 3B4, and FIGS. 4B1 and 4B2, are schematic cross-sectional views taken along a line corresponding to line IC-IC in FIG. 1A.

In a first step, the substrate 1 is prepared (see FIGS. 3A1 and 3B1). The plurality of heating resistors (heaters) serving as the discharge energy generating elements 10 are arranged on the substrate 1. A sacrificial layer 31 is provided on the substrate 1 at a position corresponding to the droplet supply port 9, in order to accurately process the surface dimension.

The sacrificial layer 31 is made of polysilicon or aluminum, which is a material capable of being etched with an alkaline solution. The sacrificial layer 31 may be desirably made of aluminum, aluminum silicon, aluminum copper, or aluminum silicon copper, which is capable of being etched with an alkaline solution at a high speed.

Also, a protection film 30 is formed on the surface of the substrate 1 and the surface of the sacrificial layer 31 (surface on which the flow passage forming member 2 is to be stacked). Wires of the heaters, or semiconductor elements for driving the heaters are not shown.

In a second step, a first contact layer 32 is formed on the surface of the protection film 30, whereas a second contact layer 33 is formed on the back surface of the substrate 1 (see FIGS. 3A2 and 3B2). In particular, the first contact layer 32 is applied on the surface of the protection layer 30 by spin coating. Similarly, the second contact layer 33 is applied on the back surface of the substrate 1. The first and second contact layers 32 and 33 may be thermoplastic resin.

Then, the first and second contact layers 32 and 33 are set by baking. Then, a positive resist is applied on the first contact layer 32 by spin coating. Then, the positive resist is exposed, developed, patterned by dry etching, and removed.

Further, a positive resist is applied on the second contact layer 33 by spin coating. The positive resist is exposed using a mask for forming the droplet supply port 9, developed, and patterned by dry etching. Then, the positive resist is removed.

In a third step, a mold material 34 is stacked on the protection film 30 and the first contact layer 32 (see FIGS. 3A3 and 3B3). In particular, a positive resist serving as the mold material 34 is patterned for a portion to be the nozzles 4, the communication passage 5, and the second opening 7. The positive resist may be, for example, ODUR (manufactured by Tokyo Ohka Kogyo Co., Ltd.).

In a fourth step, the flow passage forming member 2 is formed (see FIGS. 3A4 and 3B4). In particular, covering photosensitive resin, which is to be the flow passage forming member 2, is applied on the first contact layer 32 and the mold material 34 by spin coating.

A water repellent member 8 is formed on the surface of the flow passage forming member 2 (the surface becomes the face 13) by laminating a dry film.

The discharge ports 3 and the first opening 6 are formed by exposing and developing the flow passage forming member 2 using UV or Deep UV.

In a fifth step, the substrate 1 and the flow passage forming member 2 are covered with a protection member 35 (see FIG. 4A1 and 4B1). In particular, the face-13-side surface and the side surfaces of the flow passage forming member 2, and the side surfaces of the substrate 1 are covered with the protection member 35.

The protection member 35 is formed by spin coating. The protection member 35 employs a material sufficiently resistant to a strong alkaline solution to be used in the next step. Accordingly, the water repellent member 8 can be prevented from being deteriorated.

In a sixth step, the droplet supply port 9, the communication passage 5, and the first opening 6 are formed (see FIGS. 4A2 and 4B2). In particular, the droplet supply port 9 is formed by chemically anisotropically etching the substrate 1 with a strong alkaline tetramethylammonium hydroxide (TMAH) solution.

At this time, since the crystal orientation of the substrate is <100>, the sacrificial layer 31 on the surface of the substrate 1 is also etched. Further, the protection film 30 covering the sacrificial layer 31 is removed by etching. Hence, the droplet supply port 9 is formed. Then, the second contact layer 33 and the protection member 35 are removed.

Further, the mold material 34 is dissolved and removed, thereby forming the nozzles 4, the communication passage 5, and the second opening 7. When the mold material 34 is a positive resist, the mold material 34 may be dissolved and removed by irradiating the entire surface of the mold material 34 with a deep UV ray.

Then, the substrate 1 and the flow passage forming member 2 may be dried. Alternatively, ultrasonic immersion may be performed if necessary during dissolving and removing the mold material 34.

After the above-described steps, the substrate 1 is cut and separated by a dicing saw, thereby producing chips from the substrate 1. Then, the discharge energy generating elements 10 are electrically connected to the electrodes (not shown) provided on the substrate 1. Further, a chip tank member (not shown) is connected for supply of droplets. Thus, the liquid discharge recording head is completed.

Figure 5A:
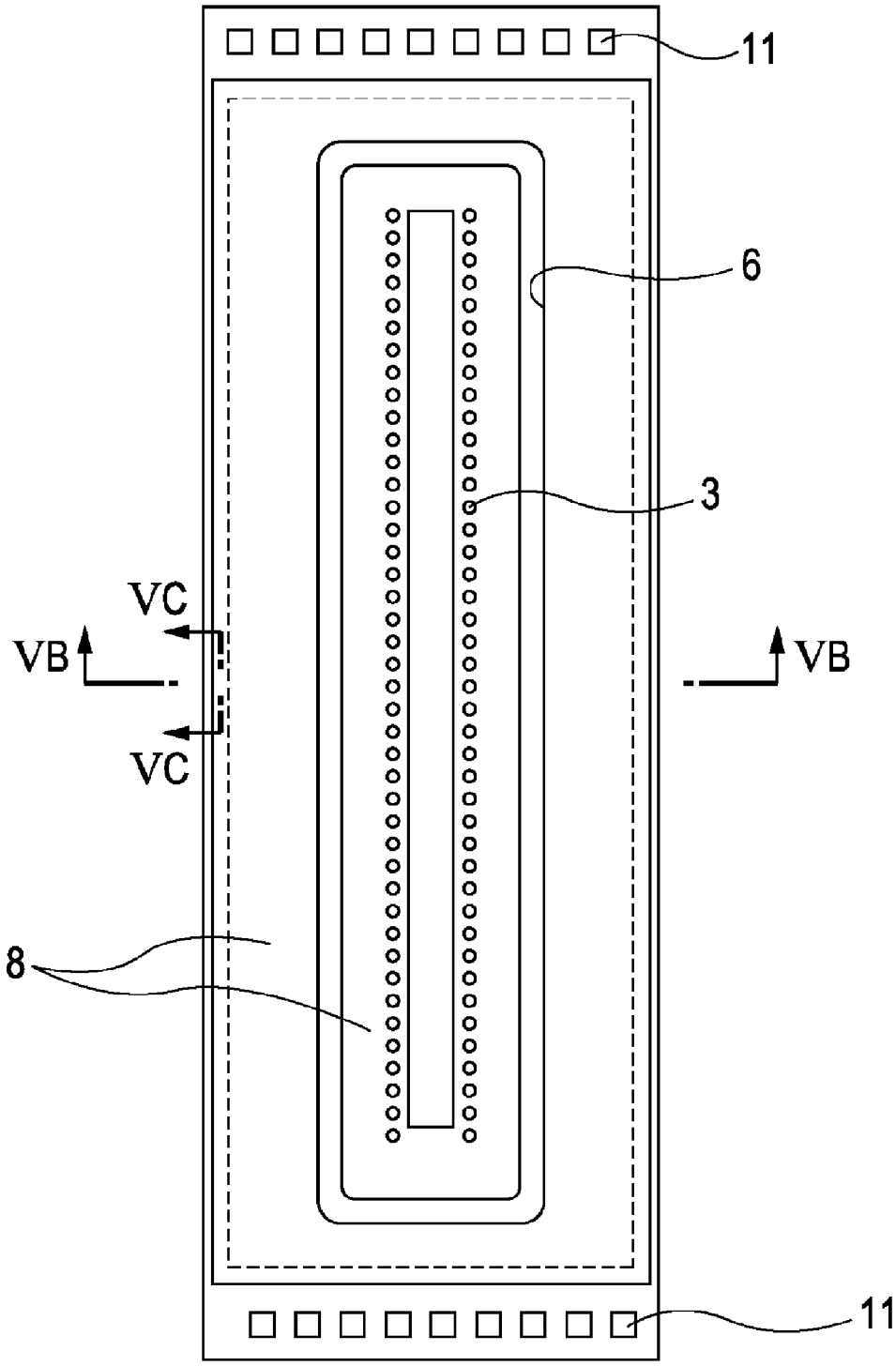
FIGS. 5A to 5C illustrate a recording head according to a second embodiment of the present invention, FIG. 5A being a schematic plan view, FIG. 5B being a schematic cross-sectional view taken along line VB-VB in FIG. 5A, FIG. 5C being a schematic cross-sectional view taken along line VC-VC in FIG. 5A.
Figure 5C:
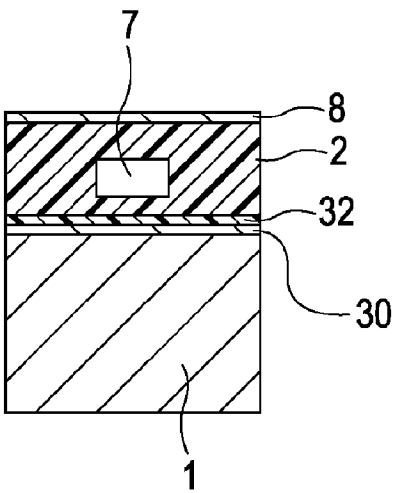
Figure 5B:
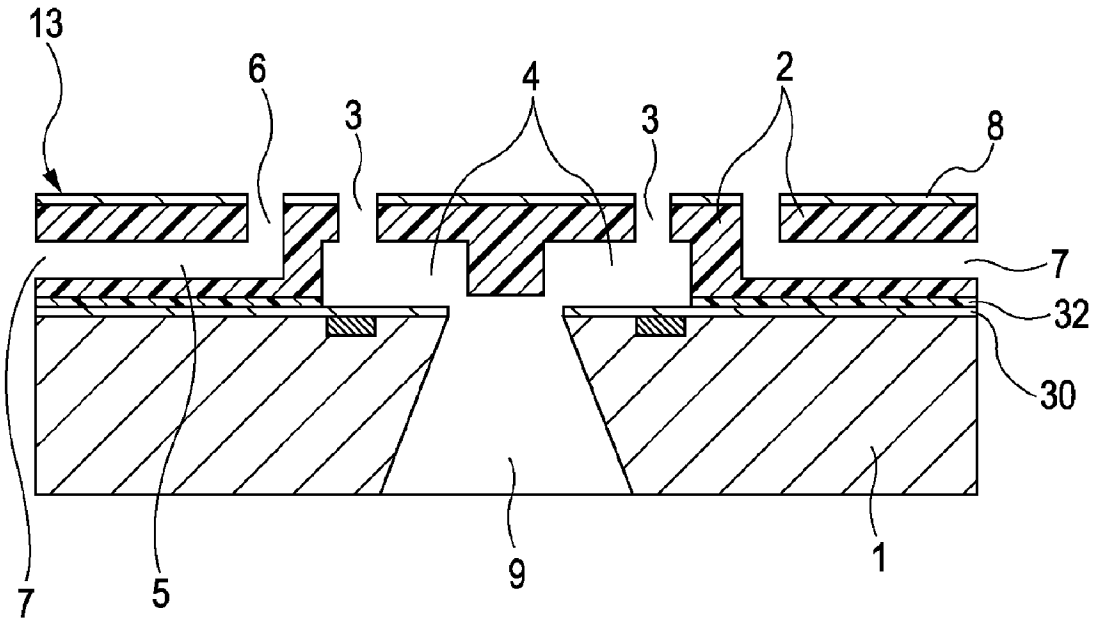

A second embodiment of the present invention is described below with reference to the attached drawings. FIG. 5A is a plan view showing a face side of a recording head according to the second embodiment of the present invention. FIG. 5B is a cross-sectional view taken along line VB-VB in FIG. 5A. FIG. 5C is a cross-sectional view taken along line VC-VC in FIG. 5A.

A liquid discharge recording head according to the second embodiment includes a substrate 1 and a flow passage forming member 2 in a similar manner to the first embodiment. The structure of the substrate 1 is similar to that of the first embodiment.

The flow passage forming member 2 has a first opening 6, and a second opening 7 that causes the inside of the first opening 6 to communicate with the outside of the flow passage forming member 2. The inside of a communication passage 5 extending from the first opening 6 to the second opening 7 is hydrophilic.

In this embodiment, the communication passage 5 is formed in the flow passage forming member 2. That is, a part of the flow passage forming member 2 is present between the communication passage 5 and the substrate 1. The other structure is similar to that of the first embodiment.

Accordingly, if a blade to be used for cleaning the face 13 is pushed into the communication passage 5, the substrate 1 can be prevented from being damaged by the blade.

Also, the substrate 1 can be prevented from being damaged during chip conveyance when a recording head is assembled. With the configuration of this embodiment, since the inside of the communication passage 5 is entirely formed of the flow passage forming member 2, wettability of the communication passage 5 becomes equivalent to that of the flow passage forming member 2. This is advantageous to holding liquid in the communication passage 5.

Next, a manufacturing method of the recording head according to the second embodiment is described. FIGS. 6A to 6F illustrate schematic manufacturing steps. These figures are cross-sectional views taken along a line corresponding to line VB-VB in FIG. 5A.

First, a first step is performed (see FIG. 6A) in a similar manner to the manufacturing method according to the first embodiment.

Figure 6A:
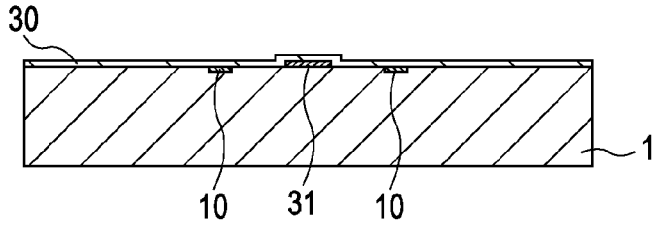
FIGS. 6A to 6F are schematic illustrations showing manufacturing steps of the recording head of the second embodiment.
Figure 6B:
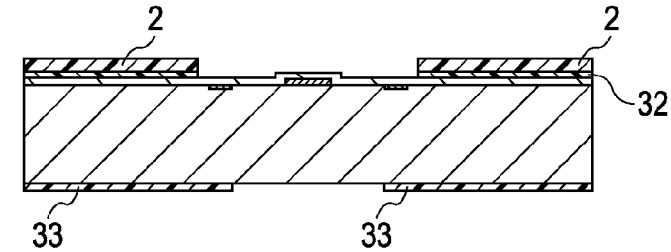
Figure 6C:
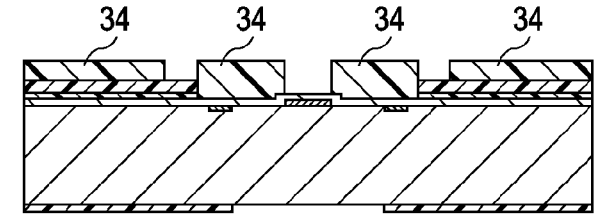
Figure 6D:
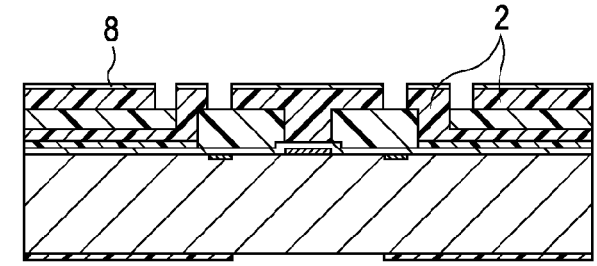
Figure 6E:
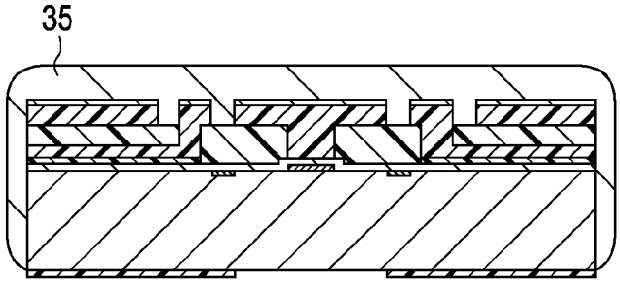
Figure 6F:
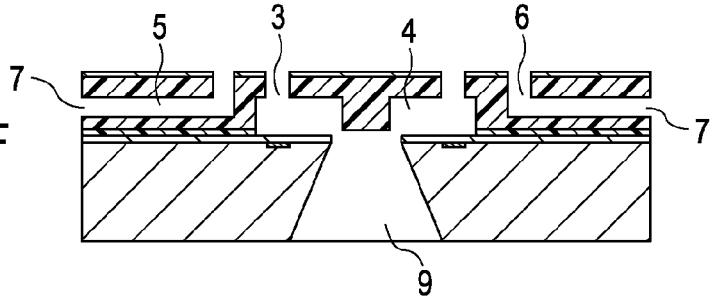

In a second step, a first contact layer 32 is formed on the surface of the protection film 30, whereas a second contact layer 33 is formed on the back surface of the substrate 1 (see FIG. 6B).

In particular, the first and second contact layers 32 and 33 are respectively formed on the surface and the back surface of the substrate 1 by spin coating, and then, are set by baking.

For patterning of the first contact layer 32, covering photosensitive resin, which is to be a part of the flow passage forming member 2, is applied by spin coating. Then, the covering photosensitive resin is exposed, developed, and patterned by dry etching.

Then, a third step (see FIG. 6C), a fourth step (see FIG. 6D), a fifth step (see FIG. 6E), and a sixth step (see FIG. 6F) are performed in a similar manner to the manufacturing method according to the first embodiment.

After the above-described steps, the substrate 1 is cut and separated by a dicing saw, thereby producing chips from the substrate 1. Then, the discharge energy generating elements 10 are electrically connected to the electrodes (not shown) provided on the substrate 1. Further, a chip tank member (not shown) is connected for supply of droplets. Thus, the liquid discharge recording head is completed.

For example, the single second opening 7 may be provided, or a plurality of the second openings 7 may be provided. A plurality of the communication passages 5 may be provided at the flow passage forming member 2.

The first opening 6 may be provided at any position as long as the first opening 6 efficiently holds small droplets adhering to the face 13 and the first opening 6 is covered with the cap 21 of the recovery unit 20.

The second opening 7 may be provided at any position as long as the second opening 7 is not covered with the cap 21.

The nozzles 4 may be arranged in any arrangement form as long as the nozzles 4 can discharge droplets onto a recording medium.

The liquid discharge recording head of the embodiments of the present invention may be mounted on, for example, a printer, a copier, a facsimile provided with a communication system, a word processor provided with a printer section, or an industry recording apparatus combined with various processing devices.

By using the liquid discharge recording head of the embodiments of the present invention, recording can be performed on a recording medium made of, for example, paper, thread, fiber, leather, fiber, metal, plastic, glass, wood, or ceramic. It is to be noted that "recording" in the specification includes application of a meaningful image, such as a character or a figure, and application of an apparently meaningless image, such as a mere pattern.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-148127 filed Jun. 5, 2008, which is hereby incorporated by reference herein in its entirety.

What is claimed is:

1. A liquid discharge recording head, comprising:

a substrate including energy generating elements used for discharge liquid and a supply port for holding liquid; and a flow passage forming member, stacked on the substrate, having discharge ports, a flow passage, the discharge ports configured to discharge droplets, the flow passage communicating with the discharge ports and the supply port, a first opening provided at a surface where the discharge ports are formed, a second opening provided at a surface different from the surface where the discharge ports are formed, and a communicating passage through which the first opening and the second opening communicate with each other, wherein the communication passage is formed separately from the flow passage.

2. The liquid discharge recording head according to claim 1, wherein the inside of the communication passage extending from the second opening to the first opening has a higher hydrophilic property than that of the surface of the flow passage forming member with the discharge ports.

3. The liquid discharge recording head according to claim 1, wherein the first opening is provided at the surface of the flow passage forming member with the discharge ports to surround all discharge ports in a circular form.

4. The liquid discharge recording head according to claim 1, wherein the second opening is provided at a surface adjacent to the surface of the flow passage forming member with the discharge ports.

5. The liquid discharge recording head according to claim 1, wherein the inner surface of the communication passage is provided by the flow passage forming member.

6. The liquid discharge recording head according to claim 1, wherein the first opening is tapered from the surface with the discharge ports toward the communication passage.

7. The liquid discharge recording head according to claim 1, wherein the communication passage is tapered toward the second opening.

8. The liquid discharge recording head according to claim 1, wherein a plurality of the second openings is provided.

9. The liquid discharge recording head according to claim 1, wherein at least a columnar material configured to support the flow passage forming member is provided in the communication passage.

10. A recording apparatus, comprising:

a liquid discharge recording head including a flow passage forming member, the flow passage forming member having discharge ports, a flow passage, a first opening, and a second opening, the discharge ports configured to discharge droplets, the flow passage communicating with the discharge ports, the first opening provided at a surface of the flow passage forming member with the discharge ports, the second opening causing the inside of the first opening to communicate with the outside of the flow passage forming member through a communication passage, the communication passage and the flow passage being formed separately from each other; and a recovery unit configured to perform a recovery process of the liquid discharge recording head while the recovery unit covers at least a part of the surface with the discharge ports, wherein while the recovery unit covers the surface with the discharge ports, the first opening is provided at a position covered with the recovery unit, and the second opening is provided at the outside of the recovery unit.

* * * * *